US008669453B2

(12) United States Patent
Garrison et al.

(10) Patent No.: US 8,669,453 B2
(45) Date of Patent: Mar. 11, 2014

(54) FOOT OPERABLE PERCUSSION INSTRUMENT

(76) Inventors: Michael Hunter Garrison, Allen, TX (US); Donald Lane Boozer, II, Denton, TX (US)

( * ) Notice: Subject to any disclaimer, the term of this patent is extended or adjusted under 35 U.S.C. 154(b) by 128 days.

(21) Appl. No.: 13/350,746

(22) Filed: Jan. 14, 2012

(65) Prior Publication Data

US 2013/0180380 A1 Jul. 18, 2013

(51) Int. Cl.
*G10D 13/02* (2006.01)

(52) U.S. Cl.
USPC ..... 84/411 R; 84/418

(58) Field of Classification Search
USPC ..... 84/411 R, 418
See application file for complete search history.

(56) References Cited

U.S. PATENT DOCUMENTS

2005/0028667 A1* 2/2005 Navarro ..... 84/418

* cited by examiner

*Primary Examiner* — Kimberly Lockett
(74) *Attorney, Agent, or Firm* — Jeffrey Roddy

(57) ABSTRACT

A foot operable percussion instrument producing jingling sounds similar to a tambourine is useable by a solo performer and possesses a wedge-shaped body with an inclined striking surface for the striking by a foot or a portion thereof. The wedge-shaped body is connected to a base plate member by a pair of rigid connectors that together define a fulcrum so that the front portion of the wedge-shaped block pivots downwardly when struck by a foot on the inclined striking surface and rights itself when the foot is lifted. The jingling sound produced is of short duration.

5 Claims, 5 Drawing Sheets

FOOT OPERABLE PERCUSSION INSTRUMENT

CROSS REFERENCE TO RELATED APPLICATIONS

Not Applicable

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

FIELD OF THE INVENTION

The present invention relates generally to percussion type musical instruments, and more particularly to foot operable percussion instruments.

BACKGROUND OF THE INVENTION

The tambourine is an ancient instrument that possesses a bent frame with multiple openings that contain small pieces of metal called jingles that clash together and sound when the frame is struck or shaken. The frame can include a stretched drumhead that combines the low sound of a drum with the high sound of the jingles. Commonly, each jingle is disc shaped, has a central aperture and is stacked atop a second jingle, forming a jingle pair. Each jingle pair is retained in the frame by a pin secured at each end to the frame and running co-axially through the jingle apertures. The apertures are sized so that the jingle pairs can freely spin, ride up and down and move slightly angularly relative to the pin. Tambourines are used frequently as a sound enriching accompaniment to other instrumentation that can include among others, fiddles, guitars and drums. Tambourines are especially useful in enriching the sound of minimally instrumented performances.

Various foot operated percussion instruments possessing tambourine-like elements have been described in the past for purposes of allowing soloists to enrich their sound, including a stand-alone tambourine which is connectable by its frame to a hinged element that when struck by a foot, shakes the tambourine. Other known instruments possess jingles which are mounted within structures affixible to a body part such as a knee, or a foot. While the forgoing types of instruments work well for their intended use, (1) many are relatively large complicated mechanisms that are difficult to pack for performances, (2) others, being attached to a body part, are difficult to control and are too easily sounded by inadvertent body movement, and (3) still others produce a vibratory sustain that is undesirable and not easily attenuated.

Accordingly, it would be desirable for a foot operable percussion instrument producing a jingling sound to be among other things, (1) compact enough to fit inside an instrument case, (2) of simple and durable construction, (3) unattached to any body part, (4) sensitive enough to sound at the slightest tap of a foot, and (5) capable of producing a sound of short duration for each tap of the foot.

SUMMARY OF THE INVENTION

The present invention is a small foot operable percussion instrument with jingles that can be packed in a guitar case, is very sensitive to tapping movement, and produces an easily controlled sound of short duration when tapped by the foot. Owing to the sensitivity of the jingles, the instrument can be played continually with minimal foot movement and without fatiguing the musician.

In one aspect, the present invention includes a solid wedge-shaped block having at least one recess on at least one side of the block that houses at least one jingle pair. The wedge-shaped block has top side with an inclined surface defining a striking zone that is downwardly impacted by the foot. A base plate for placement on the floor is beneath the block, and at least one rigid connector defining a fulcrum joins the base plate to the wedge-shaped block. While the distance separating the base plate from the wedge-shaped block is preferably between ¼ inch and 1 inch, most preferably, the distance is ⅜ inch.

When the inclined surface of the block is struck by the foot, the retaining pin for the jingles is shifted slightly out of its normal perpendicular position relative to the floor, and the jingles are sufficiently disturbed in order to create a sound. Because the pins retaining the jingle pairs only tilt slightly during the impact, the jingles vibrate together, or separate and collapse without noticeable friction. Because the connecting elements between the block and base plate are rigid, no substantial vibration of the block is induced when impacted, and the jingling sounds persist for no more than one second. Although the jingles will sound at every impact of the block, there exists a greater damping effect if the foot or a portion thereof remains in contact with the block immediately following the impact.

The jingles will sound even when tapped lightly with a finger. However, if the inclined surface is struck powerfully, one end of the wedge-shaped block will strike the base plate producing an audible "click" similar to the sound of a rim shot to a snare drum, in addition to jingling.

Although the preferred embodiment possesses a solid wedge-shaped block made of pine or a material of similar density, conceivably, the wedge-shaped block can be hollow, and formed from any suitable material having desirable resonant properties; whether wood, plastic, metal or a composite of the forgoing materials.

Although the preferred embodiment possesses common disc-shaped jingles, other jingling means will no doubt suggest themselves to those skilled in art and having benefit of this disclosure. Accordingly, it is intended that the invention encompass alternate jingling means which are long known in the art.

Other objects and advantages of the present invention will become apparent from the following descriptions, taken in connection with the accompanying drawings wherein by way of illustration and example, a preferred embodiment of the present invention is disclosed.

DETAILED DESCRIPTION OF THE INVENTION

Reference Listing

Figure 1:
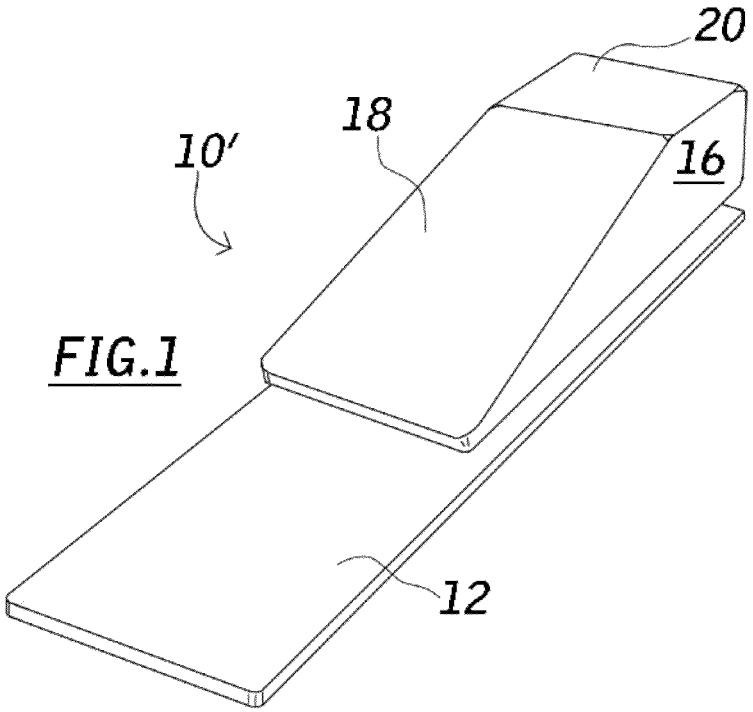
FIG. 1 is front perspective view of a preferred embodiment according to the present invention.
Figure 2:
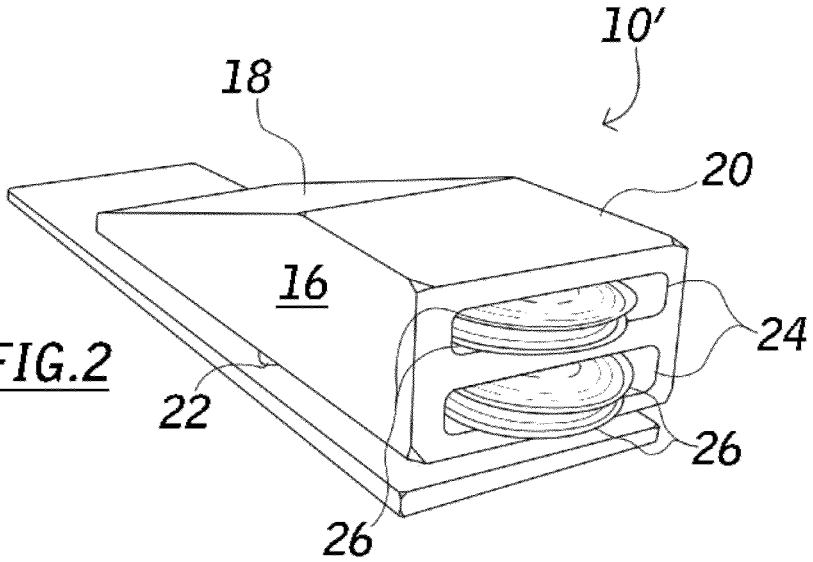
FIG. 2 is rear perspective view of a preferred embodiment according to the present invention.
Figure 3:
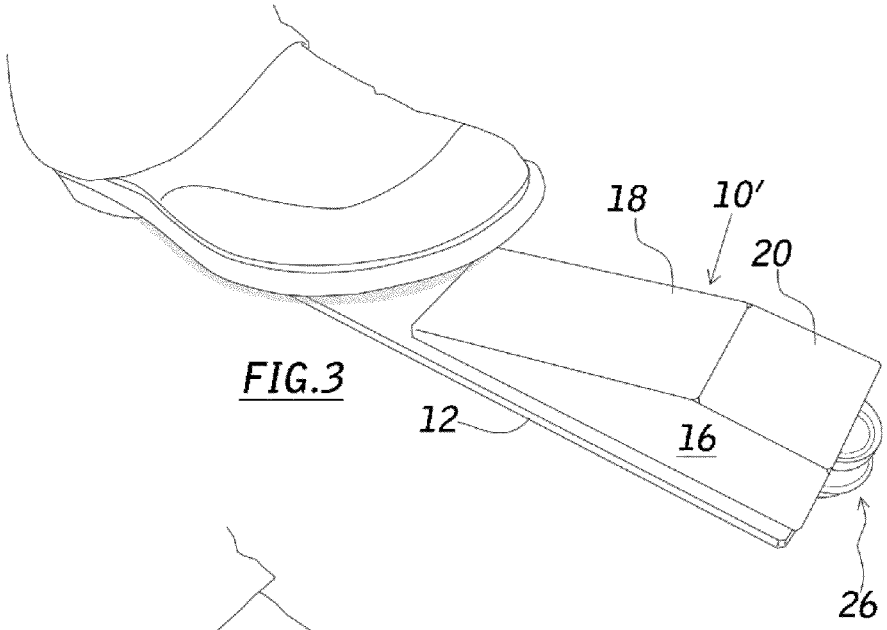
FIG. 3 is perspective view of a preferred embodiment according to the present invention in a typical use, being placed on a floor surface with a foot poised to strike inclined impact surface 18.
Figure 4:
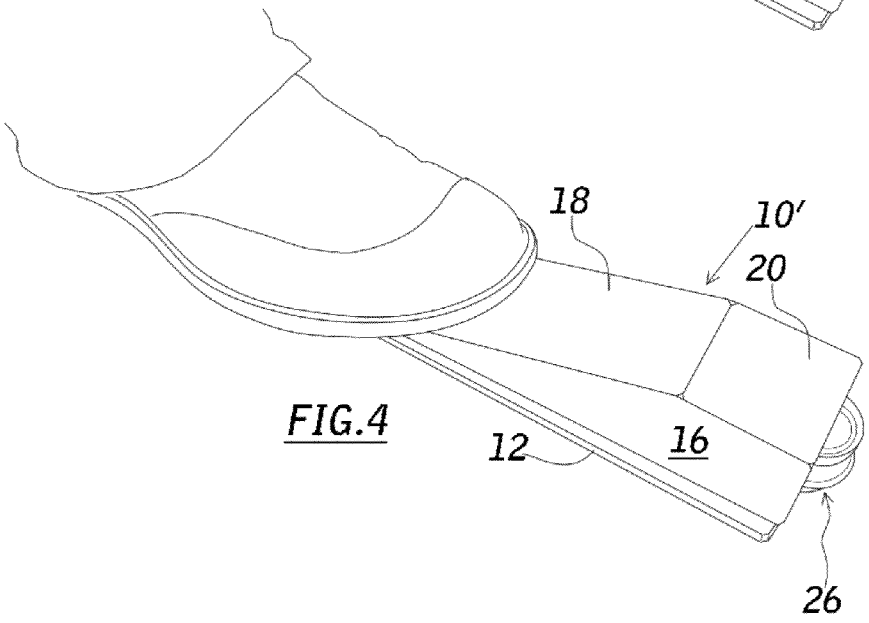
FIG. 4 is perspective view of a preferred embodiment according to the present invention in a typical use, being placed on a floor surface with a foot striking an inclined striking zone 18.
Figure 5:
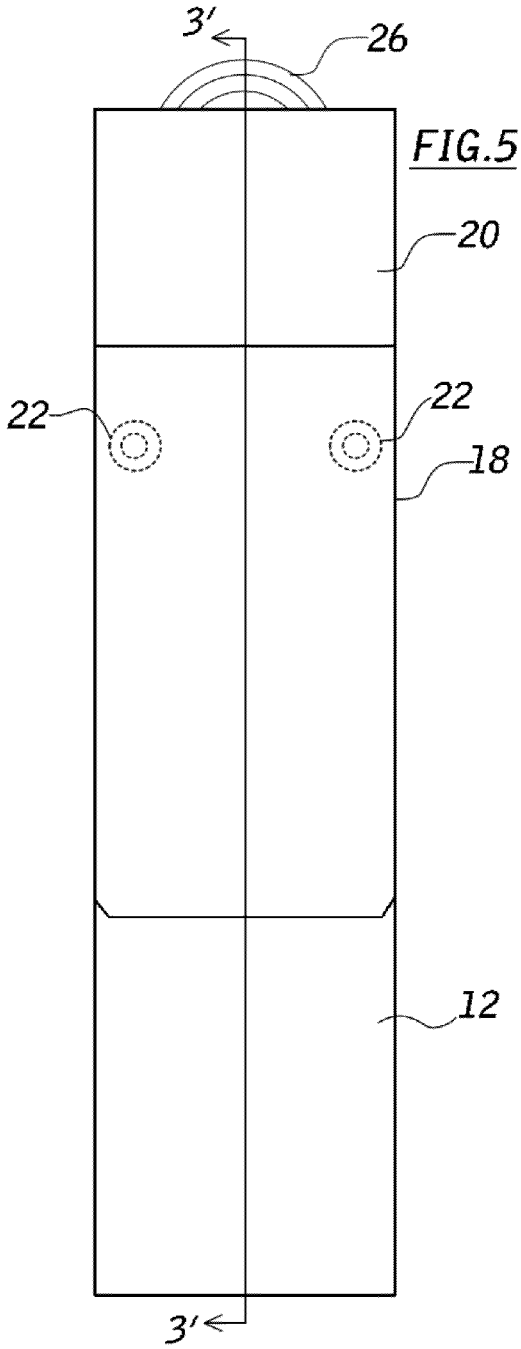
FIG. 5 is a top plan view of a preferred embodiment with dotted lines showing the relative positioning of rigid connectors 22, according to the present invention.
Figure 6:
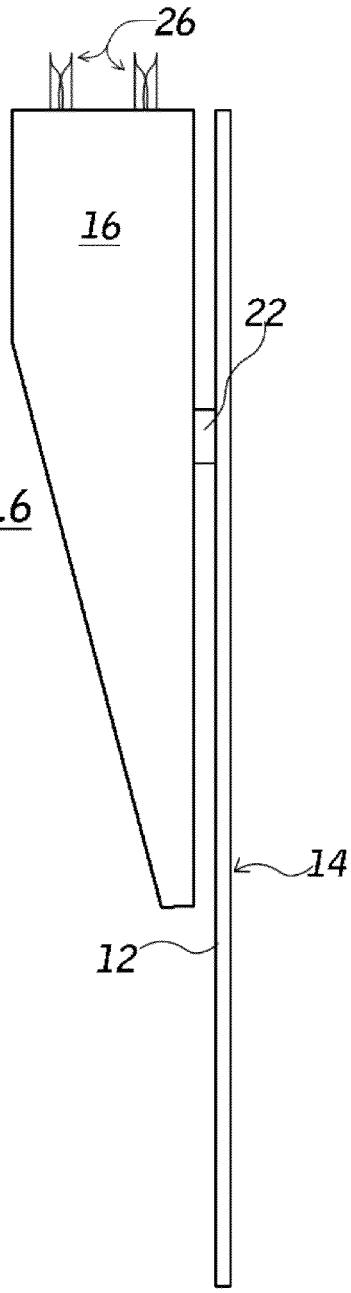
FIG. 6 is a side elevation of (FIG. 5)
Figure 7:
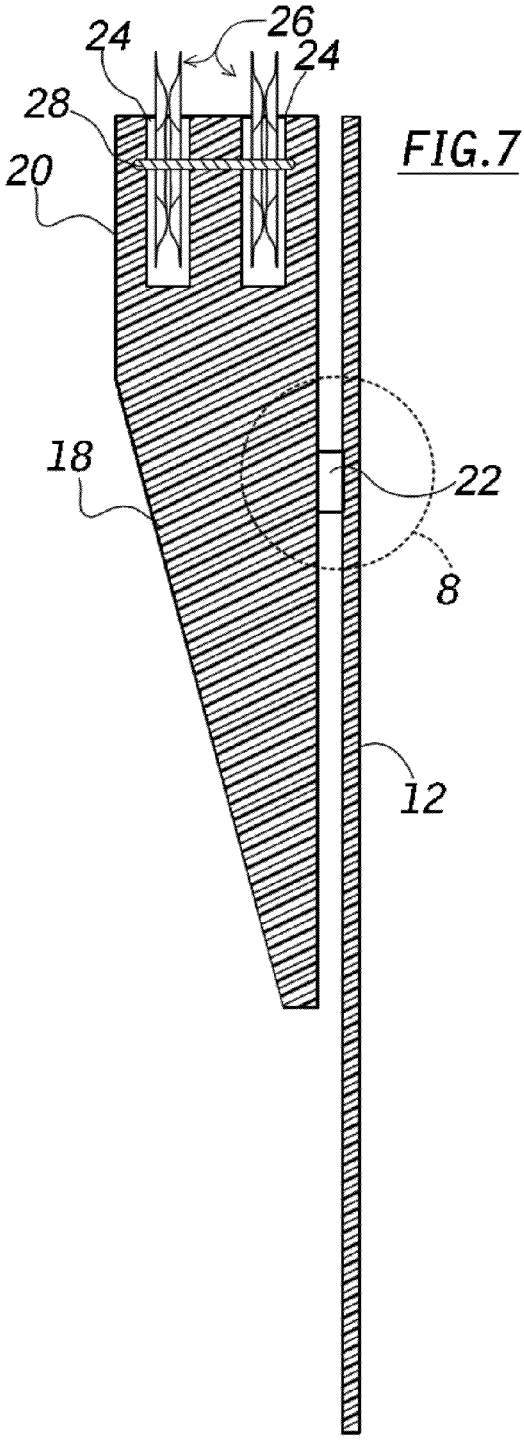
FIG. 7 is cross sectional view taken along lines 3'-3' of (FIG. 5)
Figure 8:
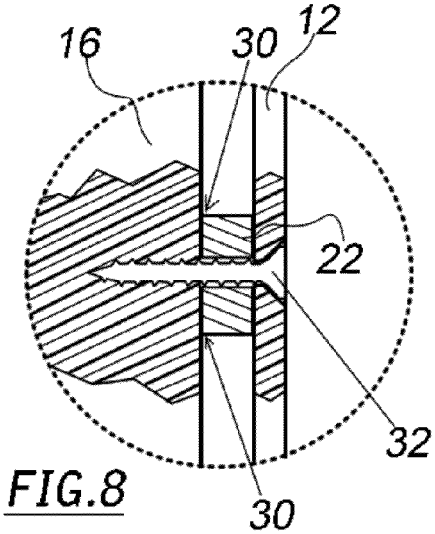
FIG. 8 is detailed cut away view showing the fastening of a rigid connector 22 between block 16 and base plate 12 taken of the region indicated by reference character 8 of (FIG. 7)
Figure 9:
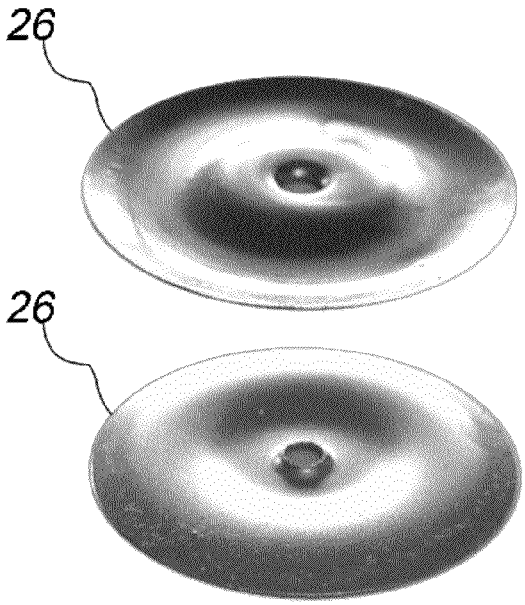
FIG. 9 shows an typical uncoupled pair of jingles with an upper jingle and a lower jingle.

10' tambotoe
12 base plate
14 block underside
16 block
18 striking zone
20 top of block
22 rigid connector
24 recesses
26 jingles
28 retaining pin
30 pivot point
32 fastener
34 spring Referring generally to FIGS. 1-10; a novel foot operable percussion instrument 10' is shown having a generally wedge-shaped block 16 with an underside 14, and a top surface 20 having an inclined striking zone 18 with an angle preferably between 5° and 25° relative to a floor surface, but most preferably between 10° and 15° relative to the floor surface. The block includes at least one recess 24 at a back side with a pair of jingles 26 residing therein, with a portion of the jingle pair extending beyond an end of the block. A retaining pin 28 is secured at two ends to the block, and passes through the apertures of each jingle pair to secure the pair in place within the recess which is formed by any means such as molding or machining. Preferably, the embodiments described herein include jingles which feature irregularities such as small convexities (not shown) that are present on the facing surfaces of the jingles so that a portions of the facing surfaces are separated slightly when the jingles are at rest. When the jingle pair is tossed, formerly non-contacting regions of the jingles clash. This is one reason for the typical "sizzle" sound of jingles. Additionally, the instrument includes a base plate 12 of generally the same width as the block, yet extending out from under the block so that a performer can rest his heel thereon. The base plate has a bottom side with non-skid material such as a rubberized pad, attached thereto (not shown), and a top side which is separated from the underside of the block by at least one rigid connector 22 defining a fulcrum. Preferably, the rigid connectors are two circular spacers of ⅜ inch thickness and no more than ½ inch diameter, with each spacer having a centered aperture, and a fastener 32 passing therethrough to join the base plate to the underside of the block into which fastener 32 penetrates. The fasteners are preferably metal, and can be wood screws, bolts, pins or any suitable replacement. The spacers bridge the gap between the base plate and block. The nexus of the top of the spacer and the contacting underside surface of the block defines the pivot point 30 between the base plate and block. The distance between the top surface of the base plate and the nexus is preferably between ¼ inch and ½ inch. The rigid connectors are connected to the underside of the block at a position substantially corresponding to the balance point of the wedge-shaped block after the installation of the jingle pairs and retaining pins. The rigid connectors permit resilient pivoting movement between the block and the base plate, yet substantially restrict the pivoting to one plane in which the block is tilted rearwardly upon impact with the foot; only to right itself when the foot is lifted. Because the spacers of the connectors 22 are rigid and relatively short in length, there is no sustained vibration of the block which provides a natural damping for the jingles, and produces a shorter duration jingling than occurs even when a tambourine is slapped against a thigh and held tightly thereto in order to damp it.

When engaging the instrument's primary sound on alternating beats, it is sometimes natural for the performer to utilize a heel tap on the other alternating beats. A sympathetic jingle sound occurs during the off-beats that is not as prominent as the primary beat sound, but provides an additional level of accompaniment.

A microphone, transducer, or piezoelectric pickup (not shown) can be temporarily placed or permanently installed at either end of the instrument to amplify the sound produced by the jingles or the click produced when the block strikes the base plate.

Those skilled in the relevant art will appreciate that the instrument can incorporate more than two sets of jingles 26 shown in the drawing figures, by making the wedge 16 wider and adding a more recesses 24.

Those skilled in the relevant art will appreciate that the base plate 12 can be made longer or shorter in length to accommodate the needs of the performer.

Figure 10:
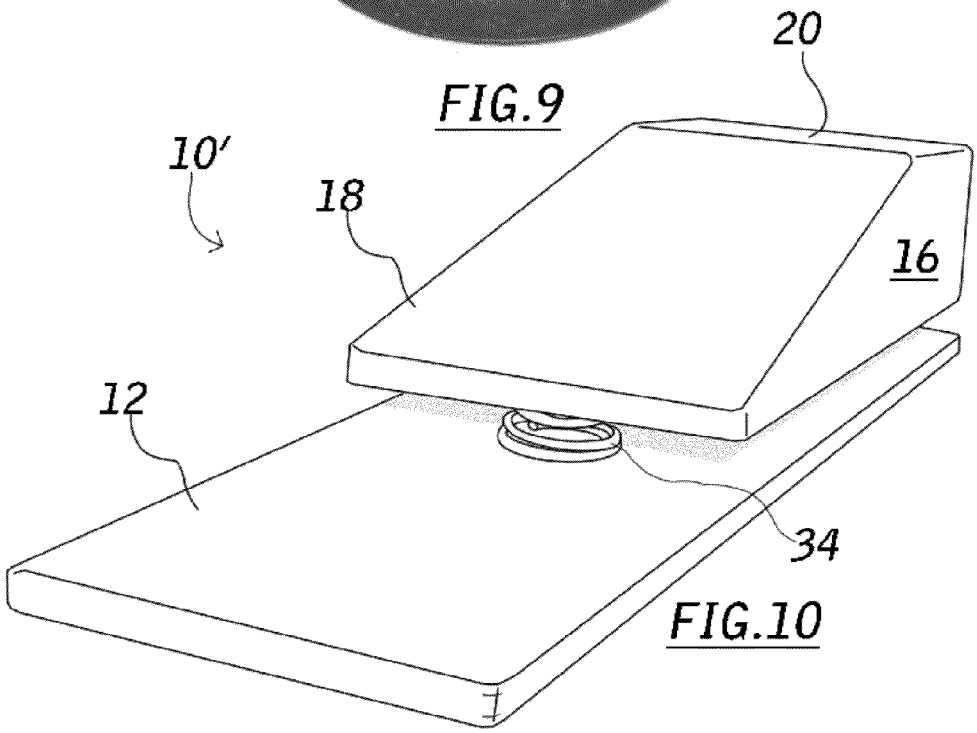
FIG. 10 shows a front perspective view of a preferred embodiment according to the present invention.

As shown in FIG. 10, although not necessary in normal use, a spring 34 can be placed beneath the base plate and the forward end of the wedge-shaped block 16 to counter any possible lag of the wedge-shaped block to right itself after being struck with the foot. In this case, one end of the spring would be inset into a recess (not shown) formed into the bottom surface 14 of the wedge-shaped block; the recess having a greater diameter than the spring, while the other end of the spring is affixed to the top of the base plate. This would allow the forward portion of the wedge-shaped block to still contact the base plate 12 when struck with sufficient force, because the spring would compress into the recess, permitting adjacent areas of the recess on the bottom of the block to contact the base plate. While the spring shown is a coil-type, any sufficiently resilient element such as a leaf-type spring, a rubber bumper, or the like, can be used as long as it permits the wedge-shaped block to strike the base plate.

Use of the Invention

Below are set forth non-limiting examples of use for the present invention and assume that the instrument is placed on the floor.

Example 1

Sound is produced by placing the heel of a foot on the base plate 12 with the toe of the foot poised above the inclined striking zone 18. The musician then proceeds to tap the toe of the foot against the striking zone while keeping the heel rested on the base plate 12.

Example 2

Sound is produced by placing the heel of a foot on the base plate 12 with the toe of the foot poised above the inclined striking zone 18. The musician then proceeds to rock his heel back and forth while maintaining contact with the base plate 12. This lifts the entire instrument off of the floor and makes a sound when the instrument strikes the ground.

Example 3

Sound is produced by poising the heel of a foot above base plate 12 with the toe of the foot poised above the inclined striking zone 18. The musician then proceeds to tap the heel and the toe simultaneously downwardly onto the base plate 12 and striking zone, respectively.

Example 4

Sound is produced by placing the heel of a foot on the base plate 12 with the toe of the foot poised above the inclined striking zone 18. The musician then proceeds to powerfully tap the toe of the foot against the striking zone while maintaining the heel on the base plate 12. This causes a portion of the wedge-shaped block 16 to strike the base plate producing an audible "click" which accompanies the jingle.

While the invention has been described by the embodiments given, it is not intended to limit the scope of the invention to the particular forms set forth. For example, although the inclined striking zone is shown as smooth, it is conceivable that ridges, nubs or other non-skid surface treatment be applied thereto. The jingles can vary in diameter and cross-sectional profile to produce different sounds. More than one jingle pair can be installed within each recess while separating the pairs by stops placed on the retaining pins. Accordingly, the description herein is intended to cover such alternatives, modifications, and equivalents as may be included within the spirit and scope of the invention as defined by the appended claims.

What is claimed is:

1. A foot operable percussion instrument comprising:

1) a wedge-shaped block having at least one exposed recess formed therein, and an inclined striking zone for striking with a portion of a human foot,
2) a base plate with a top side and a bottom side extending from beneath the block for placement of a heel of the foot,
3) at least one rigid connector defining a fulcrum conjoining the base plate to the block,
4) at least one jingle pair residing partially within the at least one exposed recess,
5) a pin placed coaxially through each jingle pair with ends of the pin secured to the block, and,
6) at least one playing position in which the base plate is placed on a floor surface, and the heel is placed on the base plate with a toe of the foot poised for striking the inclined striking zone.

2. The instrument according to claim 1 in which the pin is perpendicular to the floor's surface when the base plate is placed on the floor.

3. The instrument according to claim 1 in which the distance from the top-side of the base plate to a pivot point between the base plate and the block is no more than 1 inch in length.

4. A method of producing a jingling sound of short duration via a foot operable percussion instrument comprising the steps of:

1) providing a wedge-shaped block with an inclined striking zone having at least one exposed recess formed therein, and a base plate extending therefrom and connected to an underside of the block via at least one rigid connector, and at least one jingle pair installed at least partially within the at least one recess,
2) providing a pivot point between a top-side of the base plate and the wedge-shaped block via the at least one rigid connector,
3) placing a heel of a human foot against an extended portion of the base plate, and,
4) striking the inclined striking zone with a portion of the foot to produce a jingling sound of short duration.

5. The method according to claim 4 in which the distance from the pivot point to the top-side of the base plate is no more than 1 inch in length.

* * * * *